US006095955A

United States Patent [19]

Lee

[11] Patent Number: 6,095,955

[45] Date of Patent: Aug. 1, 2000

[54] RESISTANCE DEVICE

[76] Inventor: Jason Lee, 6F-2, No. 666-8, Sec. 2, Chung Hua Rd., Taipei, Taiwan

[21] Appl. No.: 09/238,499

[22] Filed: Jan. 27, 1999

[30] Foreign Application Priority Data

Jul. 23, 1998 [TW] Taiwan ..... 87211981
Nov. 13, 1998 [TW] Taiwan ..... 87218860

[51] Int. Cl.[7] ..... A63B 21/008
[52] U.S. Cl. ..... 482/112; 482/113
[58] Field of Search ..... 482/112–113

[56] References Cited

U.S. PATENT DOCUMENTS 123,804 2/1872 Windship ..... 482/113

FOREIGN PATENT DOCUMENTS 2267224 12/1993 United Kingdom ..... 482/112

*Primary Examiner*—John Mulcahy
*Attorney, Agent, or Firm*—Bacon & Thomas PLLC

[57] ABSTRACT

A resistance device for use in an exercising apparatus having one or more resistance elements, a force transmission device and a resistance adjusting device. Through the force transmission device, a user can apply an exercise force to the resistance elements which in general provide a resisting force derived from atmospheric pressure. To adjust the total resistance, the user may operate the resistance adjusting device to determine which resistance element(s) is(are) enabled to adjust the level of resisting force.

7 Claims, 11 Drawing Sheets

RESISTANCE DEVICE

BACKGROUND OF THE INVENTION

1. Field of the Invention

For an exercising apparatus using atmospheric pressure (i.e., vacuum means) as the source of resisting force, the major advantage is to reduce the total weight of the apparatus compared to an apparatus using gravity force (e.g., weight stacks) as the source of resisting force.

2. Description of the Related Art

For example, such apparatus like U.S. Pat. No. 5,336,150, "Lever Resistance Selection Mechanism for Strength Training" and U.K. Pat. GB2267224, "Exercising Device " reveal solutions for adjusting the resistance. Although U.S. Pat. No. 5,336,150 and GB2267224 disclose several types of resistance adjusting means, none of these resistance adjusting means can allow a user to adjust the level of resistance with a quick and easy process.

Therefore, a resistance device using atmospheric pressure as the source of resisting force with resistance adjusting means which can easily adjust the level of resisting force is necessary.

SUMMARY OF THE INVENTION

The present invention which pertains to a resistance device installed in an exercising apparatus comprises a plurality of resistance elements, a force transmission device and a resistance adjusting means. Through the force transmission device, a user may apply an exercising force to the resistance elements which in general provide a resisting force. Each resistance element comprises a vacuum chamber and an air passage which is connected to the vacuum chamber. The vacuum chamber can be expanded opposing atmospheric pressure which accordingly produces a resisting force and the air passage makes it possible to introduce air into the vacuum chamber in which case the corresponding resistance element will be disabled. By operating the resistance adjusting device which controls the close/open of the air passage of respective resistance elements, the user may adjust the level of the total resistance. Each resistance element may be designed to provide an amount of resisting force different to that of each other. By arranging different combinations of enabled resistance elements for selection, it is possible to provide more levels of resistance than the number of resistance elements.

It is an object of the present invention to provide a resistance device for an exercising apparatus of which the level of resistance can be quickly and conveniently adjusted.

A further object of the present invention is to provide resistance adjusting device which not only can adjust the level of resisting force but also can be used to release (disable) the resistance.

Another object of the present invention is to use as few of the resistance elements to achieve many different levels of resistance. For example, four resistance elements each provide 10 Kg, 20 Kg, 40 Kg, and 80 Kg resistance force. By controlling the enabled or disabled status of these four resistance elements, fifteen different levels (10 Kg, 20 Kg, . . . 150 Kg, each level has 10 Kg difference) of resistance can be provided. For example a 130 Kg resistance is provided by three enabled resistance elements, 10 Kg, 20 Kg, 40 Kg, and 80 Kg, and one disabled resistance element, 20 Kg.

Other advantages of the present invention will become apparent during the course of the following description.

DETAILED DESCRIPTION OF THE PREFERRED EMBODIMENTS

Figure 1:
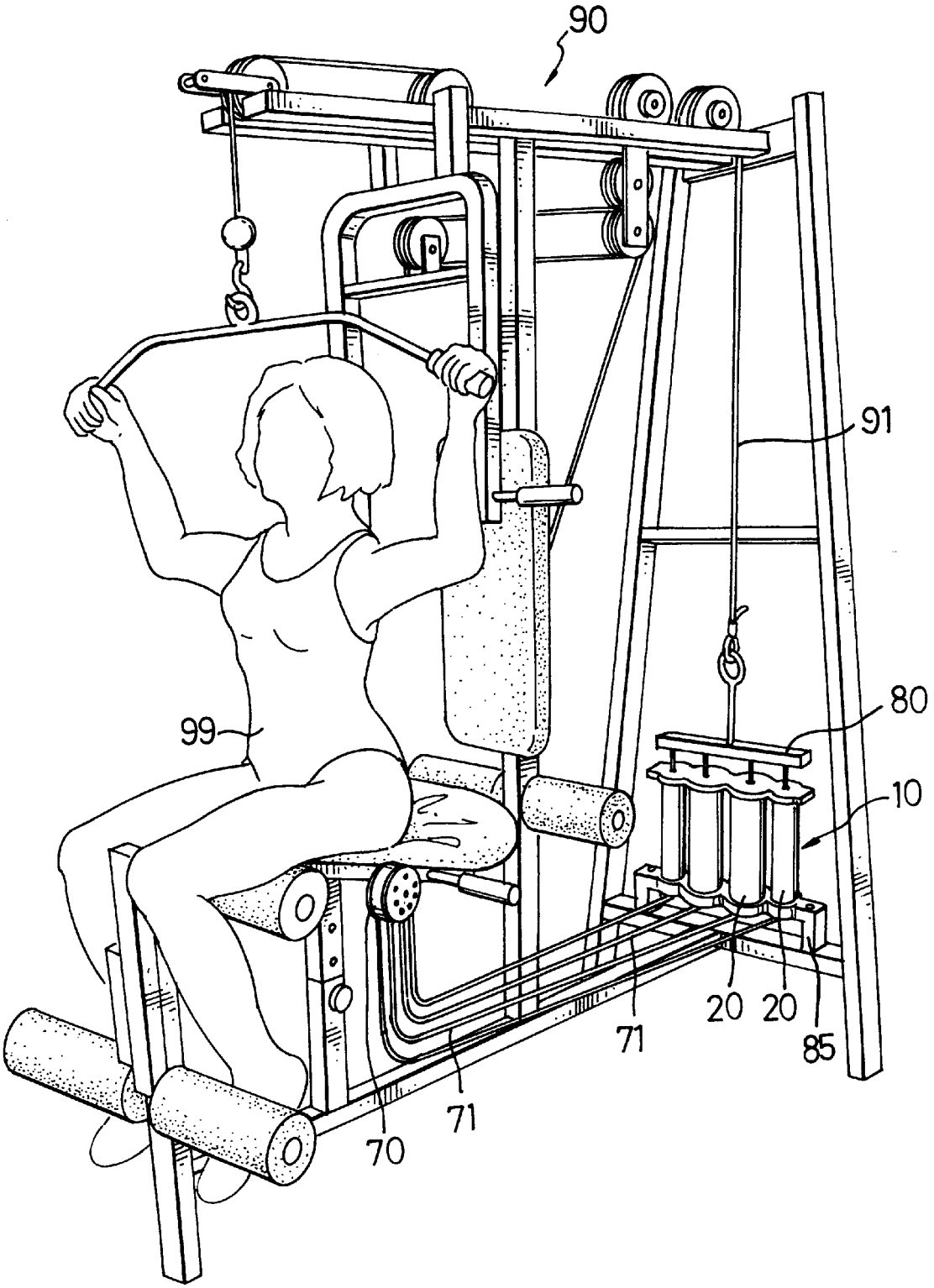
FIG. 1 is an elevational view of the first embodiment of the present invention applied in an exercising apparatus.

The present invention will now be described, by way of example, with reference to the accompanying diagrammatic drawings. FIG. 1 gives a comprehensive illustration of how the present invention is applied to an exercising apparatus 90. The resistance device 10 comprises a plurality of resistance elements 20, a force transmission device 80 and a resistance adjusting device 70. Through the force transmission device 80, a user 99 can apply an exercising force to the resistance elements 20 which provide a resisting force. By operating the resistance adjusting device 70, the user 99 can adjust the total resistance to a desired level. The fixing means 85 fix the resistance device 10 on the exercising apparatus 90. To let the user 99 access the resistance adjusting device 70 within a short distance, the extension tubes 71 connect the resistance elements 20 and the resistance adjusting device 70. During operation, the user 99 applies an exercising force to draw the resistance elements 20 through a wire 91 and the force transmission device 80.

Figure 2B:
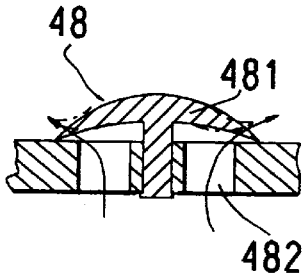
FIG. 2B is an enlarged cross-section of the one-way valve described in the first embodiment of the present invention.
Figure 2A:
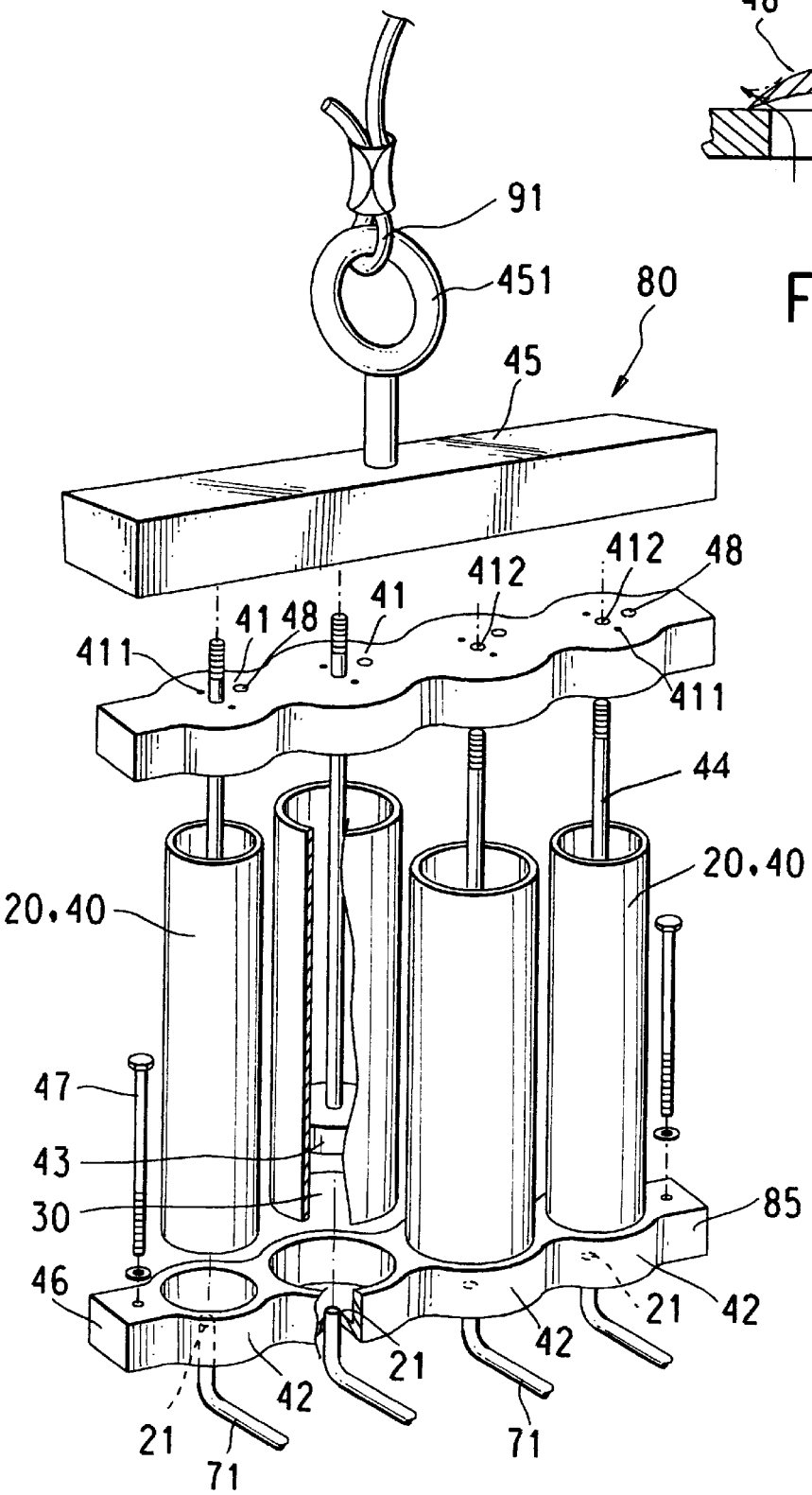
FIG. 2A is an exploded view of the first embodiment regarding the resistance elements of the present invention.

Referring to FIG. 2A regarding the first embodiment of the present invention, each resistance element 20 is a cylinder 40 (the cross-section is not limited to a circular shape), which comprises a piston head 43 and a piston rod 44. All the cylinders 40 are mounted on the fixing base 46 (i.e., the fixing device 85) which includes the end covers 42 as a part. The fixing base 46 is then fastened to the exercising apparatus 90 by bolts 47. Each end cover 42 at least has an air passage 21 to which an extension tube 71 is hermetically connected. At the top end of each cylinder 40 is fastened a top cover 41 and all the top covers 41 are combined together. Each top cover 41 has an axial through hole 412. The piston rods 44 extend from the piston heads 43 through the through holes 412 and are fixed to a pulling member 45 (i.e. force transmission device 80.) The pulling member 45 is then connected to a wire 91 by an eyebolt 451.

The edge of each piston head 43 sealingly engages the inner wall of cylinder 40 to resist passage of air in the cylinder 40 so that a vacuum chamber 30 is formed between the piston head 43 and the end cover 42. Further, an air passage 21 is connected with the vacuum chamber 30. Because such cylinders 40 uses atmospheric pressure as the source of resisting force is a prior art (e.g. U.S. Pat. No. 5,336,150), the theory and detail description will not be discussed hereafter. The amount of resisting force provided by a cylinder 40 is depended on the cross-sectional area (F=P*A).

Figure 3:
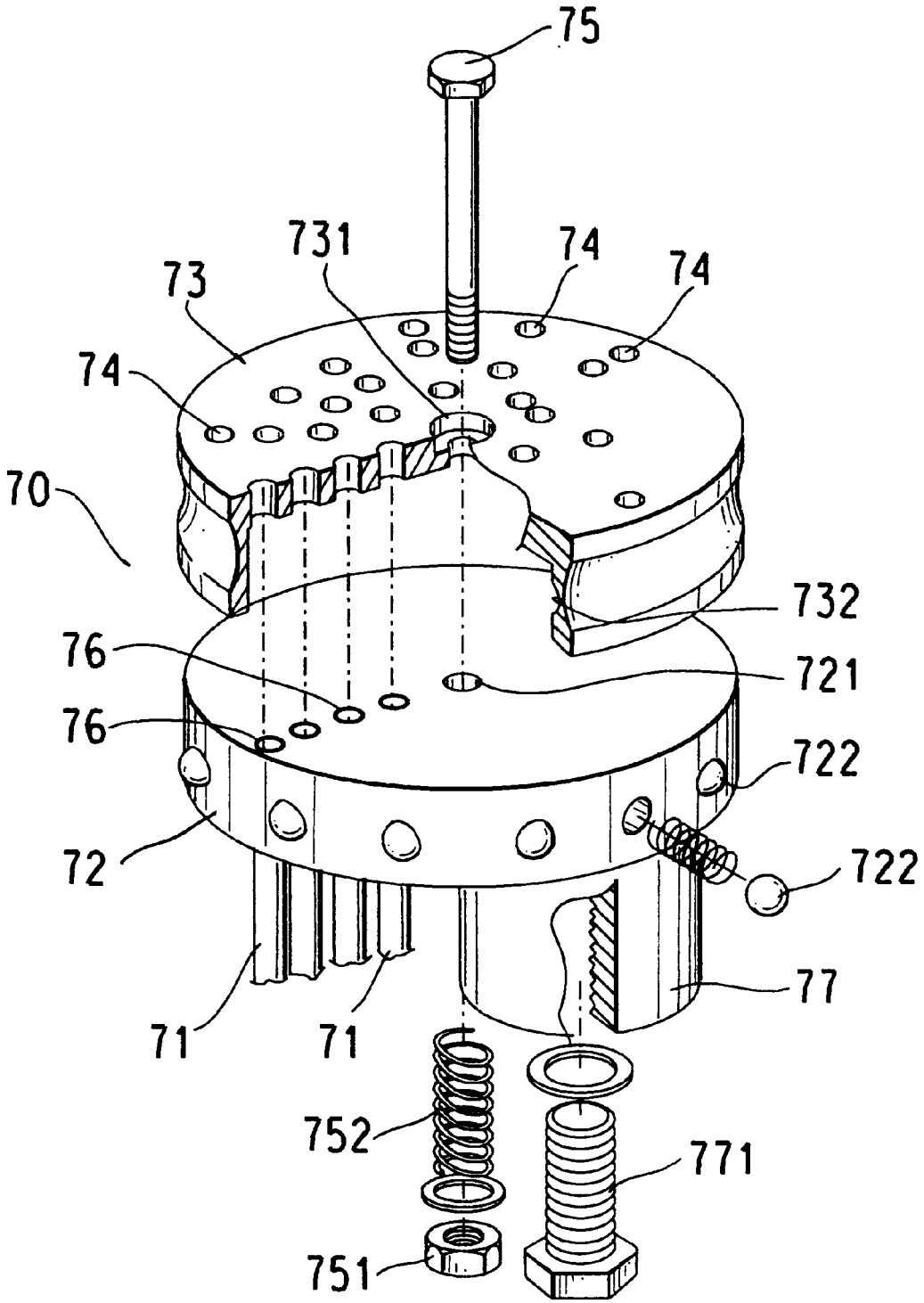
FIG. 3 is an exploded view of a preferred embodiment of the the resistance adjusting means of the present invention.
Figure 4:
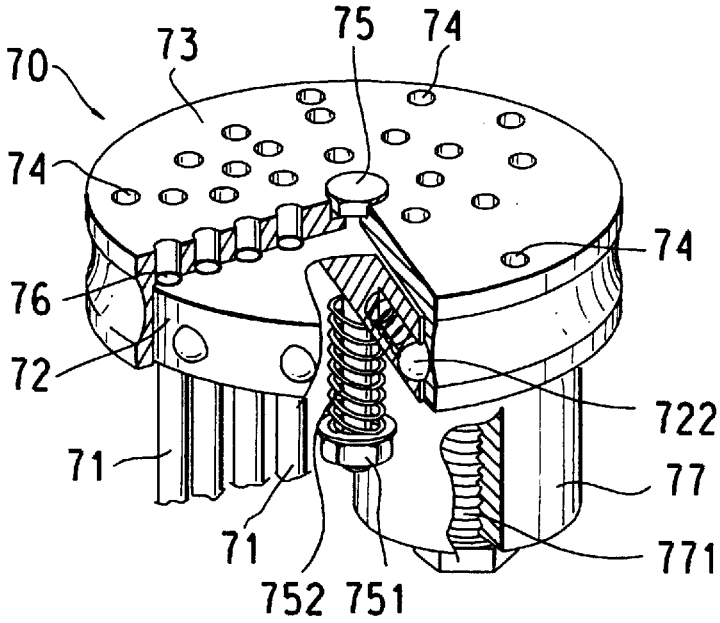
FIG. 4 is a cutaway view of FIG. 3.
Figure 5:
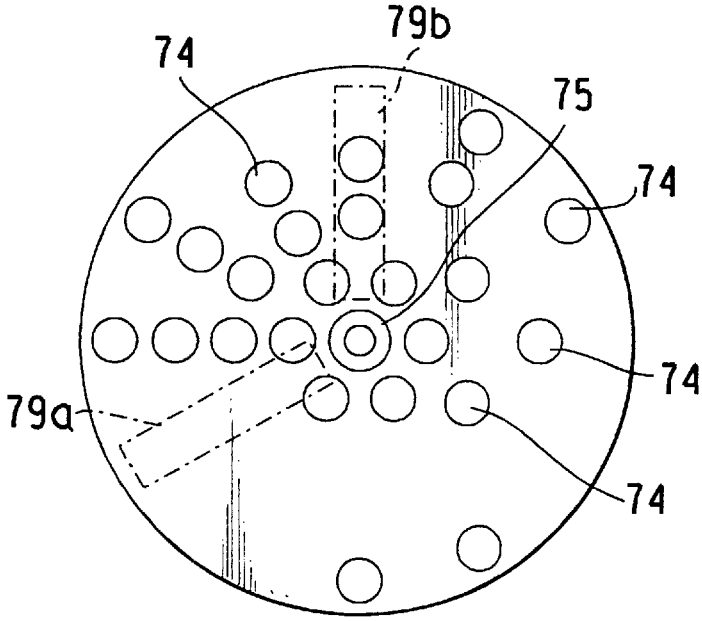
FIG. 5 is a top plain view of FIG. 3.

Referring now to FIGS. 3, 4 and 5, in a preferred embodiment, the resistance adjusting device 70 mainly comprise a valve seat 72 and a valve cap 73. A bolt 75 is sequentially inserted through the axle holes 731, 721 and a spring 752 and then screws in a nut 751, to revolvably secure the valve cap 73 onto the valve seat 72. A plurality of protrusions 722 and depressions 732 are provided respectively on the surface of the valve seat 72 and on the corresponding positions on the valve cap 73, so that the user can turn the valve cap 73 stepwise. Of course, the protrusions 722 and depressions 732 may be provided at other appropriate portions of the valve seat 72 and valve cap 73 respectively or vice versa. The resistance adjusting device 70 is mounted on the exercising apparatus 90 through a connecting arm 77 by fastening member 771.

The purpose of the resistance adjusting device 70 is to selectively close or open the air passages 21 of the resistance elements 20. The mechanism will be described hereafter. The valve seat 72 comprises a plurality of air gateways 76 which are respectively hermetically connected to the air passage 21 of the vacuum chambers 30 by extension tubes 71. The valve cap 73 comprises a plurality of valve sets 79 and each of valve sets 79 represents a level of resistance. Each valve set 79 is preferably provided with a unique combination of openings 74 which are respectively located opposed to the associated gateways 76 of the valve seat 72 when this valve set 79 connects to the gateways 76. All the openings 74 can communicate with the atmosphere. A valve set 79 may be provided with no opening 74, like valve set 79*a* illustrated in FIG. 5. So if valve set 79*a* is switched to connect to the gateways 76, the air passages 21 of all the resistance elements 20 are closed, which device that all the resistance elements 20 are enabled and the total resistance is the aggregate of that provided by every resistance element 20. For another instance, when the valve set 79*b* which has two middle openings, is switched to connect to the gateways 76, two resistance elements 20 associated to these openings are disabled because the vacuum chambers 30 of these two resistance elements 20 communicate with the atmosphere. Therefore, the total resistance provided by selecting valve set 79*b* is smaller than by selecting valve set 79*a*. Of course, the resistance adjusting device 70 may be of other forms, for example, solenoid valves combined with an electric circuit to control the open or close status of air passages 21.

Also referring to FIG. 2A again, each top cover 41 may include some small holes 411 to prevent the outside air from quickly flowing into the cylinder 40. Therefore, when a user 99 releases his/her force after the piston heads 43 were pulled up, the piston heads 43 will not quickly drop down to injure the user 99. With the design of some small holes 411, the top covers 41 should further have one-way valves 48 so that when a user 99 pulls up the piston head 43, the exhaust air can pass through the one-way valves 48 easily. FIG. 2B is a cross-section of a typical one-way valve 48 which consists of a cap 481 and openings 482.

Figure 6:
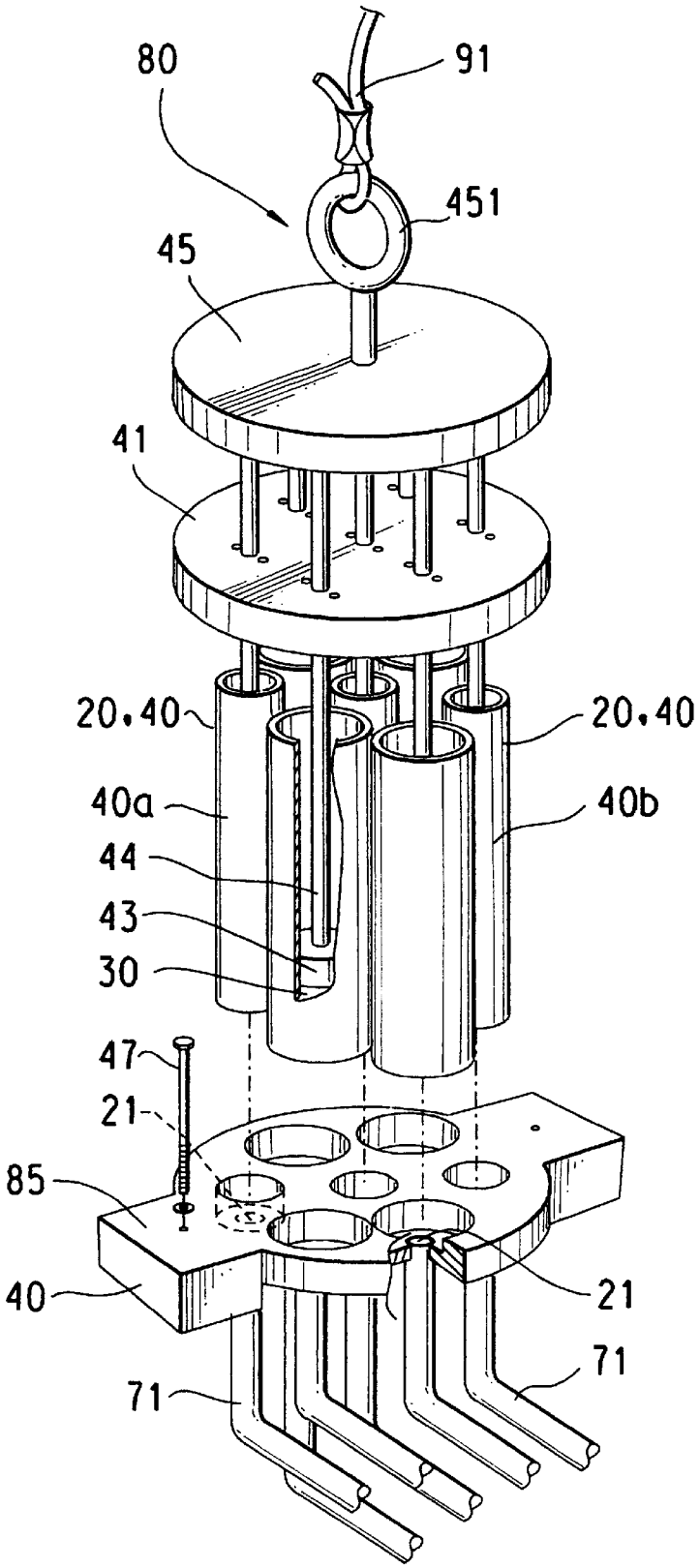
FIG. 6 is an exploded view of the second embodiment regarding the resistance elements of the present invention.

Referring to FIG. 6, the second embodiment of the present invention, the resistance elements 20 are arranged symmetrically in pairs except the one in the center. Both resistance elements 20 of a pair (for example, 20*a* and 20*b*) are identical and set to be enabled or disabled simultaneously by the resistance adjusting device 70. Therefore, all the resisting forces provided by the resistance elements 20 are balanced during operation without any torque.

Figure 7:
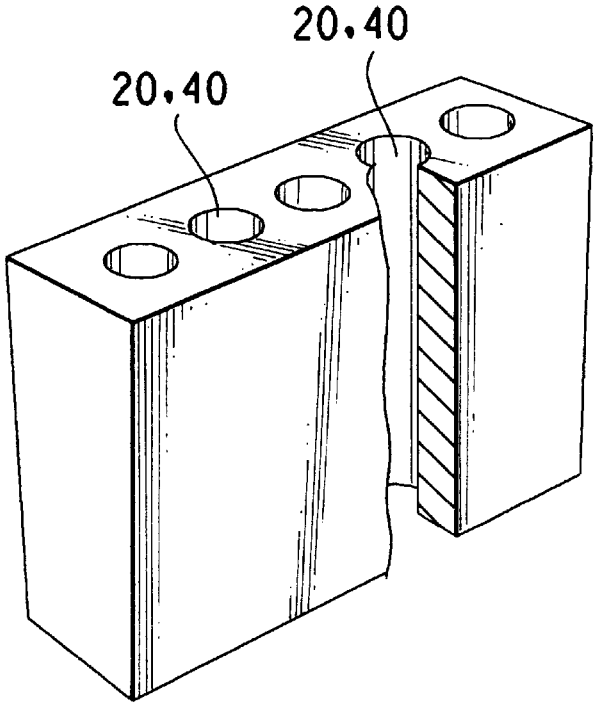
FIG. 7 illustrates a way in which the cylinder walls in FIG. 2A can be combined as a single piece.
Figure 8:
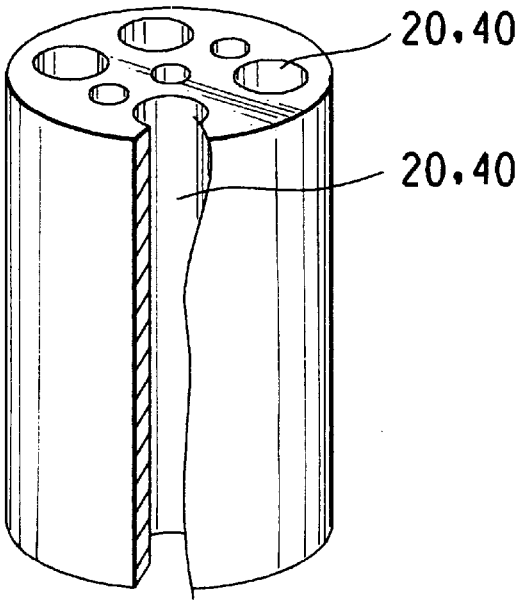
FIG. 8 illustrates a way in which the cylinder walls in FIG. 6 can be combined as a single piece.

FIGS. 7 and 8 shows that the cylinders 40 corresponding FIGS. 2A and 6 may be also manufactured as a joined single piece.

Figure 9:
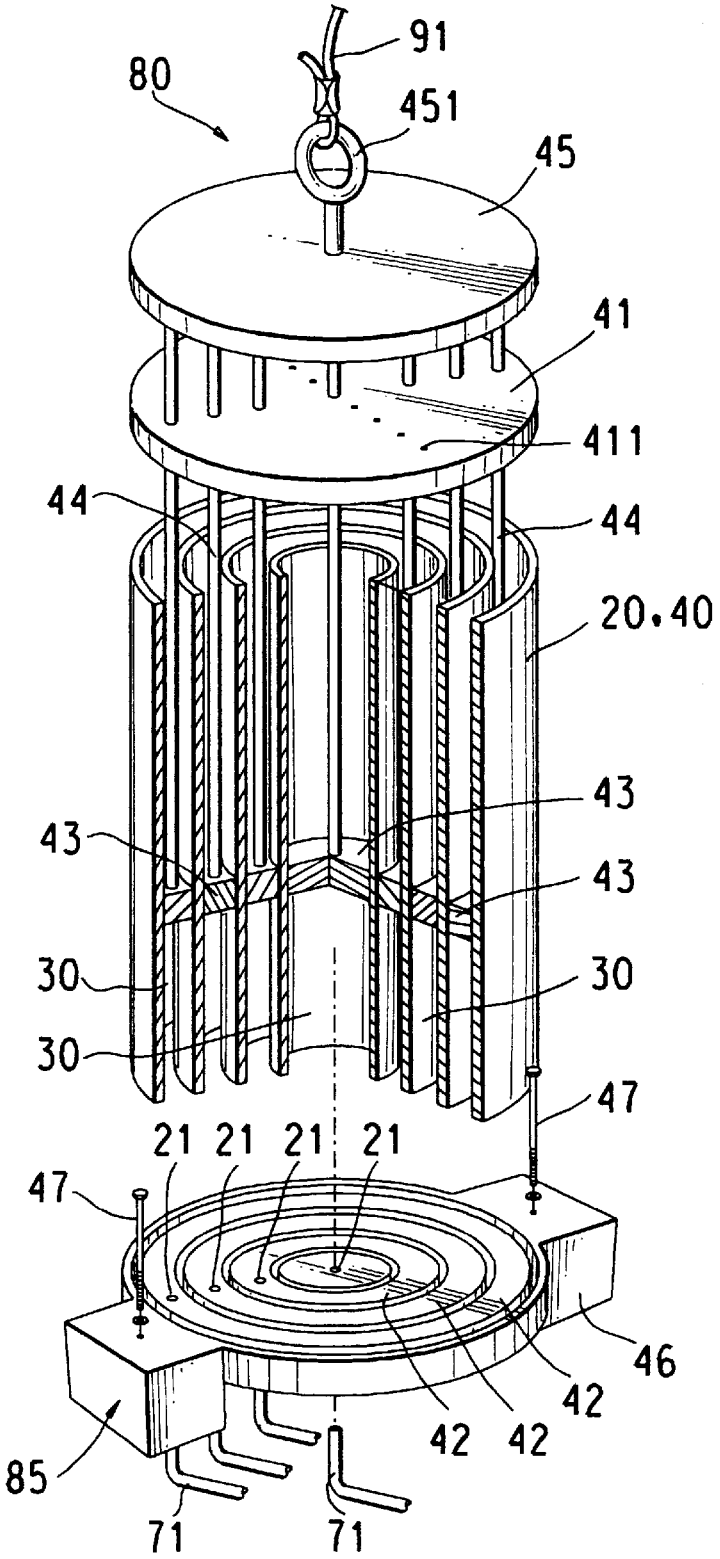
FIG. 9 is a cutaway view of the third embodiment regarding the resistance elements of the present invention.

Referring to FIG. 9, in a third embodiment of the present invention, the cylinders 40 are arranged coaxially, in which case at least two piston rods 44 must be provided for each piston head 43 except the one in the center.

Figure 10:
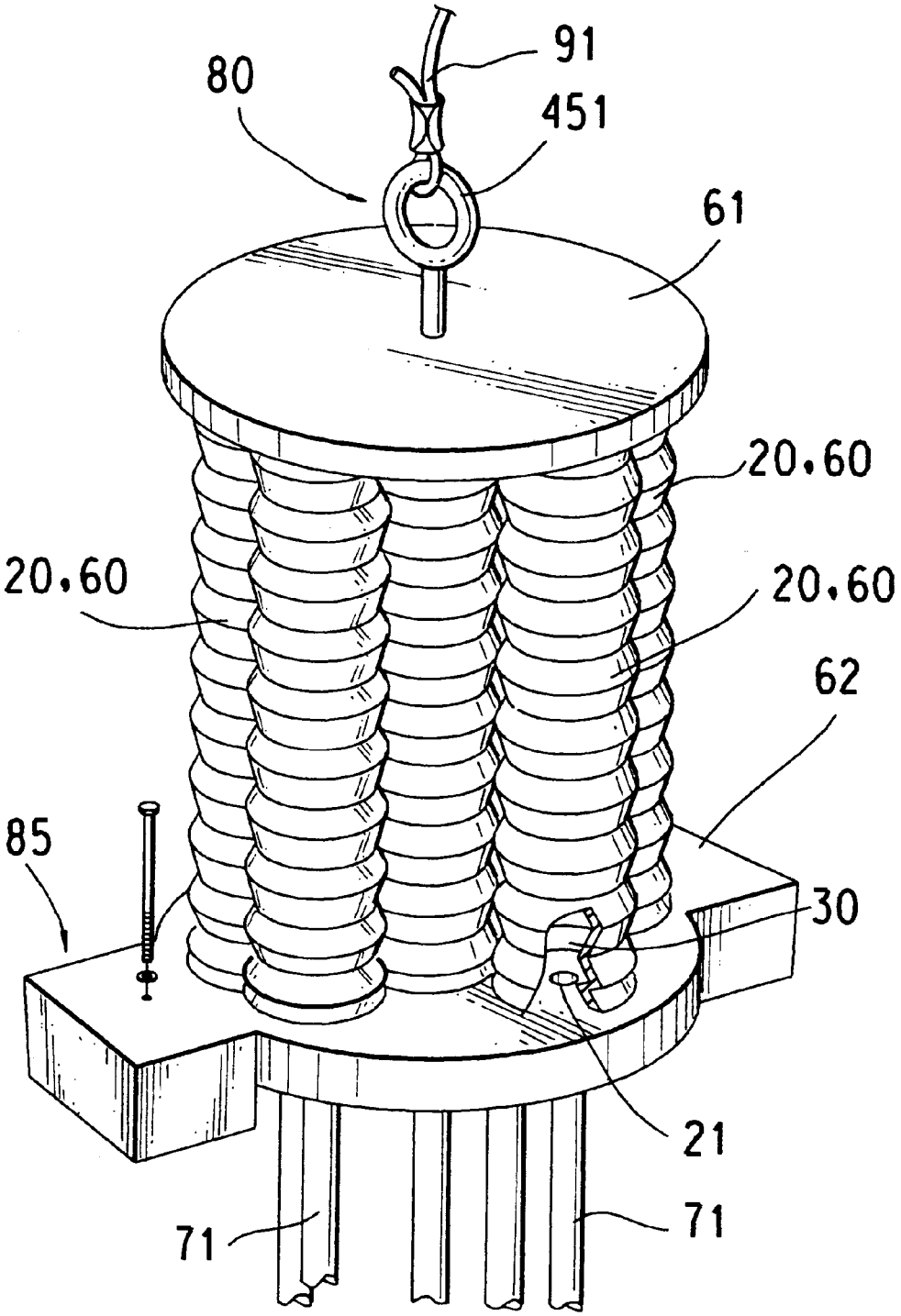
FIG. 10 is a perspective view of the fourth embodiment regarding the resistance elements of the present invention.
Figure 11:
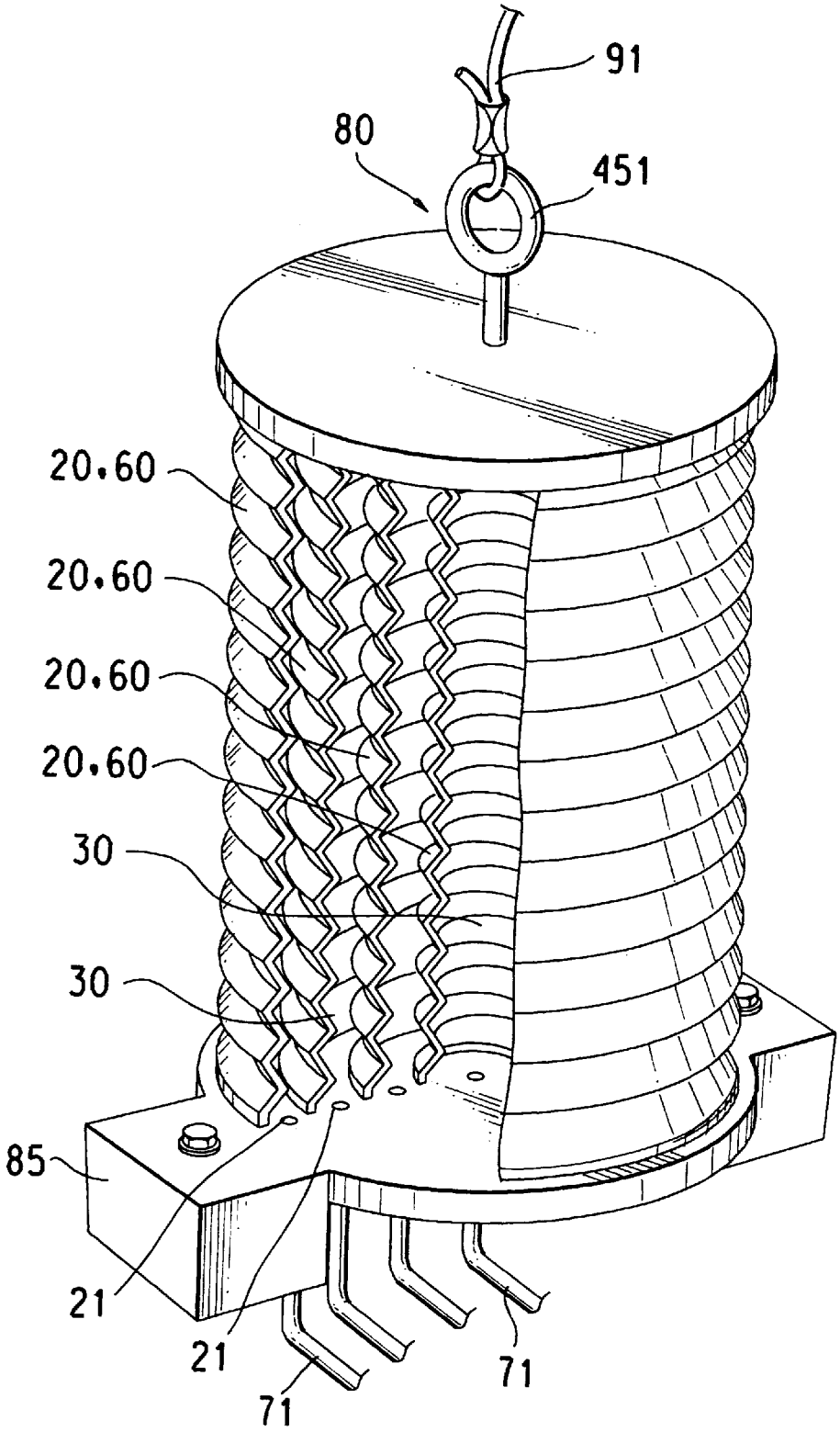
FIG. 11 is a cutaway view of the fifth embodiment regarding the resistance elements of the present invention.

Referring to FIG. 10, in the fourth embodiment of the present invention, each resistance element 20 is a flexible, variable length bellows-like sidewall 60 with two end covers 61, 62. The inside of bellows-like sidewall 60 is a vacuum chamber 30 with a variable volume. The prior art of bellows-like vacuum resistance device has been disclosed in U.S. Pat. Nos., 3,884,463 and 5,356,361. The end cover 61 and 62, each being a single piece shared by all the resistance elements 20, also act respectively as the force transmission device 80 and the fixing device 85. FIG. 11 shows a variation of the fourth embodiment, wherein the flexible side walls 60 are arranged coaxially.

Figure 12:
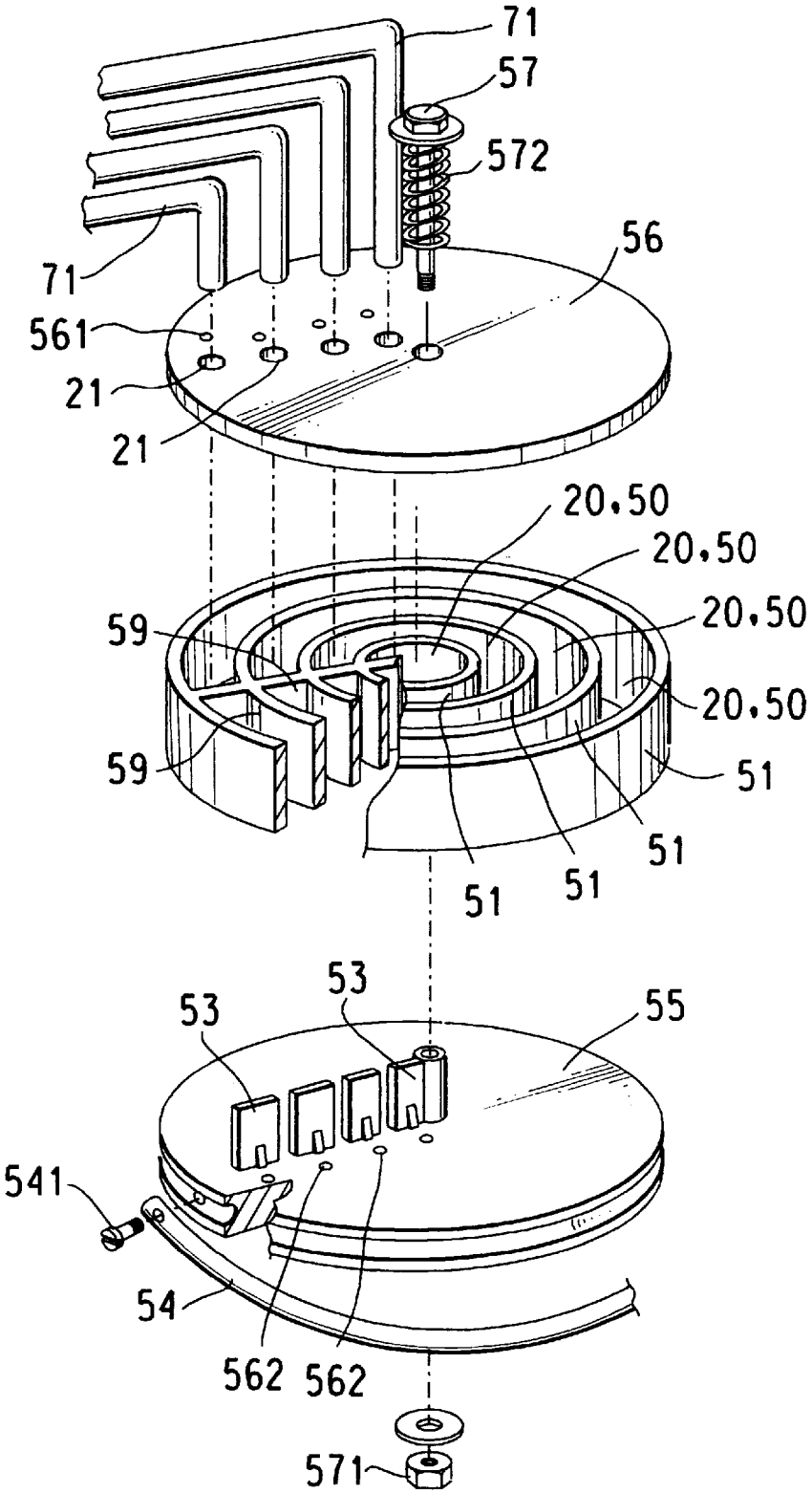
FIG. 12 is an exploded view of the sixth embodiment regarding the resistance elements of the present invention.
Figure 13:
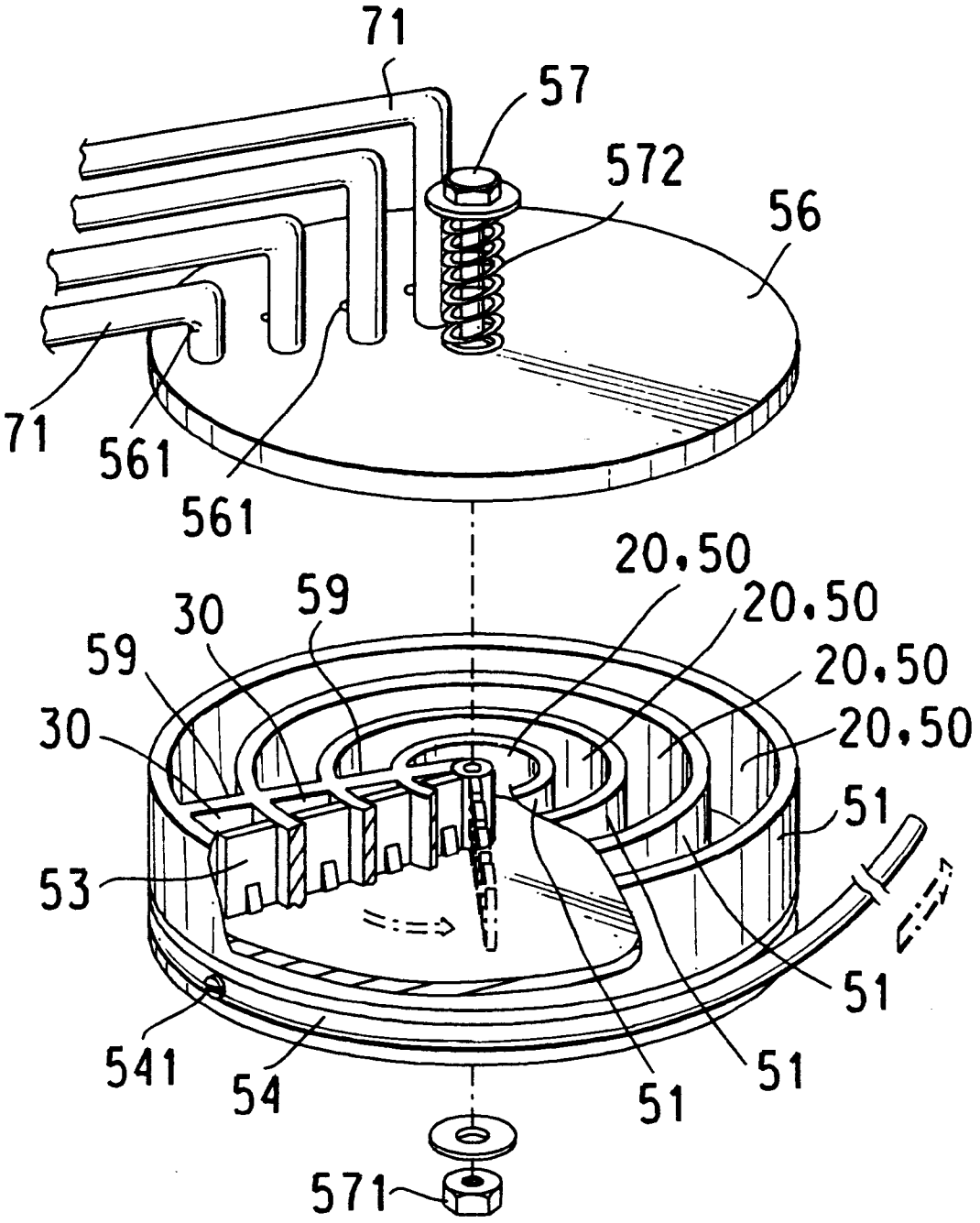
FIG. 13 is another view of FIG. 12.

FIGS. 12 and 13 illustrate the sixth embodiment of the present invention, wherein the resistance elements 20 are circular chambers 50 in annular shape and coaxially arranged. Each circular chamber 50 comprises two side walls 51, an end cover 59, a rotary disc 55, a fixing plate 56, and a rectangular piston plate 53 which is perpendicularly fixed on the rotary disc 55 and originally located contiguous to the end cover 59. The side walls 51 and the end covers 59 are tightly fixed on the fixing plate 56 (they may be also manufactured as a joined single piece). On the fixing plate 56 and adjacent to the end covers 59, a series of air passages 21 and a series of small holes 561 are provided respectively on the same side as the piston plates 53 and on the other side of the end covers 59. The small holes 562 may be disposed on the rotary disc 55 and adjacent to the piston plates 53 on the opposite side to the end covers 59, replacing or cooperating with the small holes 561. The functions of the small holes 561, 562 and of the air passages 21 which are hermetically connected to the extension tubes 71, have been described hereinbefore, please refer to the description of the first embodiment.

With the piston plates 53 being sealingly inserted into the circular chambers 50, the rotary disc 55 is sealingly and revolvably secured to the side walls 51, end covers 59 and fixing plate 56 combined by a bolt 57, a spring 572 and a nut 571. The rotary disc 55 and the fixing plate 56 also act respectively as the force transmission device 80 and the fixing device 85. The rotary disc 55 can be drawn to revolve by a wire 54 connected to and wound on its periphery, thereby moves the piston plates 53 away from the end covers 59, forming and expanding a vacuum chamber 30 thereinbetween. The mechanism of gaining an desired resistance is the same as described hereinbefore.

It is to be understood that the drawings and associated descriptions are for purpose of illustration only, and are not intended as a definition of the limits and scope of the present invention. Any modifications or variations without departing from the spirit of the present invention are included in the scope of the present invention as defined by the following claims.

I claim:

1. An atmospheric pressure resistance device for an exercise apparatus, comprising:

a plurality of resistance elements each having a vacuum chamber that can be increased or reduced in size, the resistance elements each having an air passage connected to a respective vacuum chamber; each of the air passages having an open or closed state and having no intermediate state;

a movable force transmission device connected to the resistance elements, the force transmission device arranged such that a user can apply exercise force(s) to all the resistance elements simultaneously;

a resistance adjusting device operable to selectively open and/or close one or more of the air passages of the resistance elements, such that when the air passage of a resistance element is closed, the respective vacuum chamber is substantially isolated from the atmosphere and when the air passage of a resistance element is open, the respective vacuum chamber is in communication with the atmosphere; and the resistance adjusting device arranged such that resistance to motion of the force transmission device is controllable by adjusting the number of vacuum chambers open to the atmosphere while the remaining vacuum chamber or chambers remains isolated from the atmosphere to provide resistance to motion of the force transmission device.

2. The resistance device of as recited in claim 1, wherein each of the resistance elements includes a cylinder with a piston head and a piston rod.

3. The resistance device as recited in claim 2, wherein the cylinders are arranged coaxially.

4. The resistance device as recited in claim 1, wherein each of the resistance elements include circular chambers of annular shape that are coaxially arranged;

each of the circular chambers include two side walls, an end cover, a rotary disc, a fixing plate, and a rectangular piston plate that is perpendicularly fixed on the rotary disc and initially located contiguous to the end cover; and the vacuum chamber is formed between the piston plate and the end cover, so that when the rotary disc is rotated, the vacuum chamber is expanded such that a user can receive a resisting force from the atmospheric pressure.

5. The resistance device of claim 1, wherein the resistance elements are flexible and include a variable length bellows-like sidewall.

6. The resistance device as recited in claim 1, wherein the resistance adjusting device further includes a plurality of extension tubes which connect the resistance adjusting device and the air passages of the vacuum chambers, so that the distance between the resistance adjusting device and the resistance elements can be elongated.

7. An atmospheric pressure resistance device for an exercise apparatus, comprising:

a plurality of resistance elements each having a vacuum chamber that can be increased or reduced in size, the resistance elements each having an air passage connected to a respective vacuum chamber;

each of the air passages having an open or closed state and having no intermediate state;

a movable force transmission device connected to the resistance elements, the force transmission device arranged such that a user can apply exercise force(s) to all the resistance elements simultaneously;

a resistance adjusting device operable to selectively open and/or close one or more of the air passages of the resistance elements, such that when the air passage of a resistance element is closed, the respective vacuum chamber is substantially isolated from the atmosphere and when the air passage of a resistance element is open, the respective vacuum chamber is in communication with the atmosphere;

the resistance adjusting device arranged such that resistance to motion of the force transmission device is controllable by adjusting the number of vacuum chambers open to the atmosphere while the remaining vacuum chamber or chambers remains isolated from the atmosphere to provide resistance to motion of the force transmission device;

the resistance adjusting device comprising a valve seat having a plurality of air gateways hermetically connected to respective air passages of the resistance elements, a valve cap that is shiftable on the valve seat and a plurality of valve sets, wherein each valve set comprises a combination of openings that may be placed in communication with the atmosphere; and the valve cap being movable for selecting particular air gateways to be connected with the openings to thereby render the corresponding resistance element open to the atmosphere and unable to resist motions of the force transmission device.

* * * * *